US010703555B2

(12) United States Patent
Ogawa

(10) Patent No.: US 10,703,555 B2
(45) Date of Patent: Jul. 7, 2020

(54) FLOW PIPE, AND JET NOZZLE PIPE AND AEROSOL VALVE PIPE USING SAID FLOW PIPE

(71) Applicant: Osamu Ogawa, Tochigi (JP)

(72) Inventor: Osamu Ogawa, Tochigi (JP)

(73) Assignee: Osamu Ogawa, Tochigi (JP)

( * ) Notice: Subject to any disclaimer, the term of this patent is extended or adjusted under 35 U.S.C. 154(b) by 0 days.

(21) Appl. No.: 15/760,225

(22) PCT Filed: Dec. 22, 2015

(86) PCT No.: PCT/JP2015/085755
§ 371 (c)(1),
(2) Date: Mar. 14, 2018

(87) PCT Pub. No.: WO2017/056342
PCT Pub. Date: Apr. 6, 2017

(65) Prior Publication Data

US 2018/0257847 A1 Sep. 13, 2018

(30) Foreign Application Priority Data

Sep. 30, 2015 (JP) ..... 2015-193121

(51) Int. Cl.
*B65D 83/62* (2006.01)
*B05B 9/04* (2006.01)
(Continued)

(52) U.S. Cl.
CPC ..... *B65D 83/32* (2013.01); *B05B 7/0491* (2013.01); *B05B 9/04* (2013.01); *B05B 15/20* (2018.02); *B65D 83/14* (2013.01); *B65D 83/303* (2013.01)

(58) Field of Classification Search
CPC ..... B65D 83/14; B65D 83/32; B65D 83/303; B05B 9/04; B05B 9/047; B05B 7/0491; B05B 15/20
(Continued)

(56) References Cited

U.S. PATENT DOCUMENTS 4,142,652 A * 3/1979 Platt ..... B65D 83/54 222/189.06
4,298,475 A * 11/1981 Gartner ..... A47G 21/188 210/266
(Continued)

OTHER PUBLICATIONS

English translation of JP 2007-320639A, Kimio Kataoka, Daizo Corporation, Dec. 13, 2007, attached as a PDF file (furnished by Espace.net). (Year: 2007).*

*Primary Examiner* — Paul R Durand
*Assistant Examiner* — Andrew P Bainbridge
(74) *Attorney, Agent, or Firm* — Luoh J. Wu; Continent Patent Office LLP

(57) ABSTRACT

[Problem] To provide a flow path tube that prompts gas/liquid stirring of fluids flowing through a tube channel, enables adjustment of the flow rate, and furthermore suppresses passage of foreign substances.
[Solution means] A flow path tube 1 is configured by inserting and disposing within a tube channel 12 of a flow path tube body 10 at least one or more porous materials 20 having a continuous void structure and a necessary length/a necessary diametrical dimension. Moreover, at least one or more ejection holes 18 are formed at given positions in the flow path tube body 10 or in the porous material 20 to form a jet nozzle tube 14 using the flow path tube 1. Furthermore, a valve body 26 is attached to the base end 10*c* of the flow path tube body 10 to form an aerosol valve tube 16 using the flow path tube 1.

3 Claims, 11 Drawing Sheets

(51) Int. Cl.

| | |
|---|---|
| ***B65D 83/14*** | (2006.01) |
| ***B65D 83/32*** | (2006.01) |
| ***B65D 83/30*** | (2006.01) |
| ***B05B 7/04*** | (2006.01) |
| ***B05B 15/20*** | (2018.01) |

(58) Field of Classification Search
USPC ..... 222/189.06–189.11, 402.1–402.25, 222/464.1–464.7, 190
See application file for complete search history.

(56) References Cited

U.S. PATENT DOCUMENTS

| | | | | | |
|---|---|---|---|---|---|
| 4,418,846 | A * | 12/1983 | Pong | B65D 83/32 | 222/189.1 |
| 5,156,335 | A * | 10/1992 | Smith | A47G 21/188 | 210/266 |
| 5,238,155 | A * | 8/1993 | Blake, III | A45D 27/10 | 222/190 |
| 5,273,649 | A * | 12/1993 | Magnusson | C02F 1/002 | 210/232 |
| 5,842,607 | A * | 12/1998 | Snider | A45D 27/10 | 222/145.6 |
| 6,250,508 | B1 * | 6/2001 | Geser | B67D 7/0277 | 222/189.1 |
| 10,077,150 | B2 * | 9/2018 | Laidler | B05B 11/0059 | |
| 2013/0214007 | A1 * | 8/2013 | Simonian | B65D 51/1644 | 222/189.06 |
| 2015/0360853 | A1 * | 12/2015 | Nicmanis | B05B 7/0025 | 516/10 |
| 2018/0257847 | A1 * | 9/2018 | Ogawa | B05B 9/04 | |

* cited by examiner

| 10 g hexane ejection time | | | GAS110-54-3 | | |
|---|---|---|---|---|---|
| kinetic viscosity 0.486 cSt | | | ejection amount 10g (including ejection gas LPG) | | |
| ejection pressure | | | 0.294 MPa | 0.284 MPa | 0.280 MPa |
| single-hole valve | valve length | 5 mm | 34.42 | 49.36 | 51.35 |
| | | 7 mm | 41.28 | 62.25 | 78.42 |
| | | 10 mm | 45.19 | 57.04 | 77.38 |
| porous material | porous material length | 5 mm | 34.76 | 49.56 | 61.78 |
| | | 7 mm | 52.08 | 63.84 | 67.96 |
| | | 10 mm | 58.69 | 67.26 | 76.95 |

| 10 g butyl cellosolve ejection time | | | GAS 111-76-2 | | |
|---|---|---|---|---|---|
| kinetic viscosity 8.836 cSt | | | ejection amount 10g (including ejection gas LPG) | | |
| ejection pressure | | | 0.294 MPa | 0.275 MPa | 0.255 MPa |
| single-hole valve | valve length | 5 mm | 82.94 | 42.31 | 36.97 |
| | | 7 mm | 38.54 | 49.33 | 48.61 |
| | | 10 mm | 44.20 | 51.27 | 94.15 |
| porous material | porous material length | 5 mm | 43.63 | 47.94 | 55.44 |
| | | 7 mm | 56.09 | 64.17 | 75.36 |
| | | 10 mm | 79.46 | 71.34 | 130.41 |

FLOW PIPE, AND JET NOZZLE PIPE AND AEROSOL VALVE PIPE USING SAID FLOW PIPE

TECHNICAL FIELD

The present invention relates to a flow path tube within the tube channel of which fluids flow and further relates to a jet nozzle tube and an aerosol valve tube using the flow path tube.

BACKGROUND ART

In structures for spray/aerosol, a spray can or an aerosol can contains, in addition to a content, liquefied gas such as LPG and butane or gas such as nitrogen, carbon dioxide, and air for ejecting the content. The content is ejected from a jet nozzle provided at an upper part of the can via an aerosol valve tube disposed in the can. Alternatively, a nozzle tube is further attached to the jet nozzle and the content is ejected from an ejection outlet provided at the leading end of the nozzle tube.

In ejecting the content in such a spray can or an aerosol can, the content and the gas are separated and ejected alternately. Consequently, the content is ejected discontinuously and failure in stable ejection is a problem.

Moreover, the amount of ejected content depends on the gas pressure in the can. The ejection occurs with a high pressure at the beginning and abruptly weakens as the gas pressure drops with time. Consequently, failure in constant ejection amount is also a problem.

In order to realize stable and constant ejection of the content, it is necessary to realize a constant gas pressure for a long time and mix the content and the gas well without separating or dividing them. Hence, various researches have been conducted hitherto for developing a gas to obtain a stable gas pressure for a long time or for structurally improving the spray can itself. However, such researches are still midway. On the other hand, in regard to a liquid flow path tube including a nozzle tube and an aerosol valve tube that structurally realizes stable and constant ejection of the content, there are methods using a flow rate stabilizer in the prior art. However, a flow rate stabilizer cannot be mounted in a flow path tube, requires adjustments, and is complex in structure and expensive in product cost, thus not allowing everyone to realize stable ejection.

Then, the present applicant previously developed a jet nozzle tube comprising a valve structure for mixing with the gas and realizing stable and constant ejection of the content and proposed the techniques in the patent application of patent documents 1 and 2. According to these proposed techniques, a valve structure is provided within a jet nozzle tube to enable adjustment of the flow rate by the diameter of a through-hole in the valve structure and to stir the content and the gas while they pass through the through-hole, whereby excellent effect on realizing stable and constant ejection of the content is obtained.

However, although yielding certain effect on stirring and mixing the content and the gas, the proposed techniques in the patent documents 1 and 2 cause foaming as a whole and fail to realize a completely stirred, and entirely uniformly mixed state. Consequently, the content eventually ejected is not in perfect mist to the extent of floating in the air.

The present applicant focused on the problem that the above prior art spray can or aerosol can fails to realize stable and constant ejection of the content, conceived of the idea for solving the problem by stirring and mixing the fluids (a liquid and a gas) that flow within a flow path tube, developed a technique for reliably stirring and entirely uniformly mixing the fluids (a liquid and a gas) within a flow path tube, and finally proposed the "flow path tube and jet nozzle tube and aerosol valve tube using flow path tube" according to the present invention.

PRIOR ART DOCUMENTS

Patent Documents

Patent Document 1: Japanese Unexamined Patent Application Publication No. 2012-254397; and Patent Document 2: Japanese Unexamined Patent Application Publication No. 2013-252515.

SUMMARY OF THE INVENTION

Problem Solved by the Invention

With the view of the above problem, the present invention addresses a problem to provide a flow path tube that can reliably stir and entirely uniformly mix fluids (a liquid and a gas) that flow within the tube channel of a flow path tube and a jet nozzle tube and an aerosol valve tube using the flow path tube.

Problem Solution Means

In order to solve the above problem, the present invention provides a flow path tube comprising a porous material within the tube channel of a flow path tube body, wherein the porous material has a continuous void structure, a necessary length, and a necessary diametrical dimension enabling insertion into the tube channel of the flow path tube body, and at least one or more porous materials are inserted and disposed of at given positions within the tube channel of the flow path tube body.

Moreover, the present invention provides a flow path tube comprising a porous material within the tube channel of a flow path tube body, wherein the porous material has a continuous void structure and comprises an insert part having a necessary length and a necessary diametrical dimension enabling insertion into the tube channel of the flow path tube body and a leading end part having a necessary length and a necessary diametrical dimension, and the insert part of the porous material is inserted from the leading end of the flow path tube body and fixed within the tube channel.

Furthermore, the present invention provides the above flow path tube wherein the porous material is made of a sintered body or foam of resin (polyethylene resin, polypropylene resin, polyurethane resin, phenol resin, polyvinyl chloride resin, urea resin, silicone resin, fluororesin, polyimide resin, and melamine resin) or ceramic or metal.

Furthermore, the present invention provides the above flow path tube wherein the pores of the porous material may be 10 to 300 m, preferably 20 to 120 μm, and further preferably 40 to 100 μm.

Furthermore, the present invention provides the above flow path tube wherein the porosity (void volume) of the porous material may be 30 to 80%.

Furthermore, the present invention provides a jet nozzle tube using the above flow path tube wherein the flow path tube body is closed at the leading end, and at least one or more ejection holes are formed in either one or both of the closed, leading end face, and the outer periphery near the leading end of the flow path tube body.

Furthermore, the present invention provides a jet nozzle tube using the above flow path tube wherein the flow path tube body is opened at the leading end, a resin material is applied on the leading end face of the porous material to form a coating for the purpose of sealing, and at least one or more ejection holes are formed in either one or both of the leading end face of the porous material on which the coating is formed and the outer periphery of the flow path tube body at the position at which the porous material is disposed.

Furthermore, in the above jet nozzle tube, the porous material may be disposed next to the leading end or near the leading end at a given distance from the leading end within the tube channel of the flow path tube body.

Furthermore, the present invention provides a jet nozzle tube using the above flow path tube wherein a resin material is applied on the outer surface of the leading end part of the porous material to form a coating for the purpose of sealing, and at least one or more ejection holes are formed in either one or both of the outer surface of the leading end part of the porous material on which the coating is formed and the outer periphery of the flow path tube body at the position at which the insert part of the porous material is disposed.

Furthermore, the present invention provides an aerosol valve tube using the above flow path tube wherein a valve body is attached to the base end of the flow path tube body.

Efficacy of Invention

The flow path tube according to the present invention can be produced by a simple work of inserting and disposing a porous material having a continuous void structure within the tube channel of a flow path tube body and yields excellent effects such as reliably stirring and entirely uniformly mixing fluids (a liquid and a gas) that flow within the tube channel by providing the porous material within the tube channel, preventing foreign substances from flowing out by the filtering effect of the porous material, and furthermore enabling adjustment of the flow rate by the length, pores, and porosity (void volume) of the porous material.

Moreover, using the above flow path tube, the jet nozzle tube according to the present invention yields excellent effects such as preventing the ejection holes from being clogged with foreign substances by the filtering effect of the porous material, enabling stable and constant ejection by the stirring and mixing action on fluids (a liquid and a gas) that flows within the tube channel, and furthermore realizing an entirely uniformly mixed state of fluids (a liquid and a gas) and spraying the content of a spray can or an aerosol can in perfect mist to the extent of floating in the air.

Moreover, using the above flow path tube, the aerosol valve tube according to the present invention yields excellent effects such as preventing the ejection holes from being clogged with foreign substances by the filtering effect of the porous material and enabling stable and constant ejection by the stirring and mixing action on fluids (a liquid and a gas) that flow within the tube channel.

MODE FOR IMPLEMENTING THE INVENTION

Figure 1:
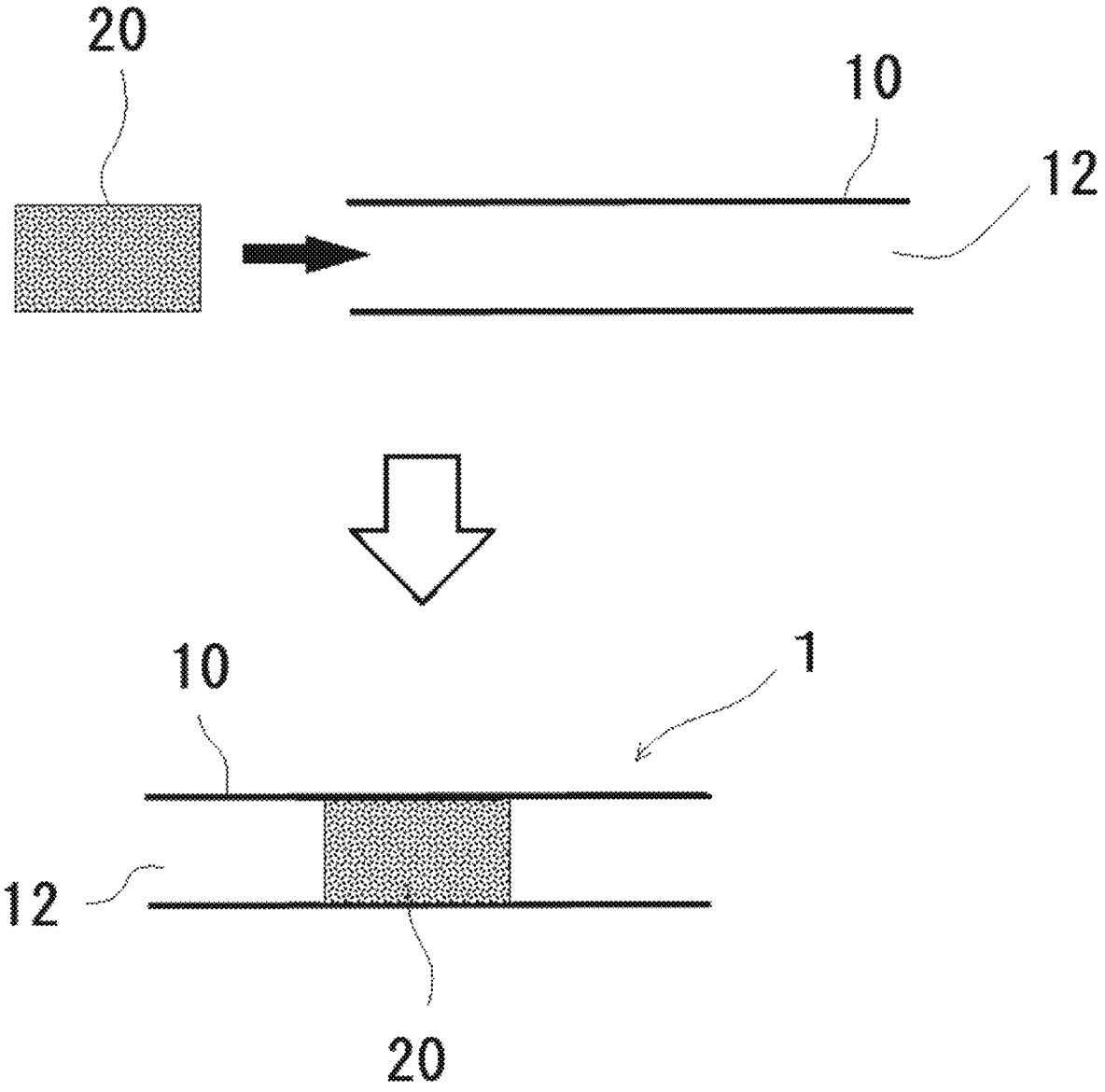
FIG. 1 A cross-sectional view showing an embodiment of the flow path tube according to the present invention (Embodiment 1)

The present invention is most characterized in that a flow path tube 1 has a structure in which at least one or more porous materials 20 having a continuous void structure are inserted and disposed at given positions within a tube channel 12 of a flow path tube body 10 and that the flow path tube 1 is used to form a jet nozzle tube 14 and an aerosol valve tube 16.

Embodiments of the flow path tube 1 and the jet nozzle tube 14 and the aerosol valve tube 16 using the flow path tube 1 according to the present invention will be described hereafter based on the drawings.

Here, the present invention is not confined to the embodiments described below and can be modified as appropriate within the scope of technical idea of the present invention, namely within the range of shapes and/or dimensions that can yield the same action/effect.

Embodiment 1

Figure 2:
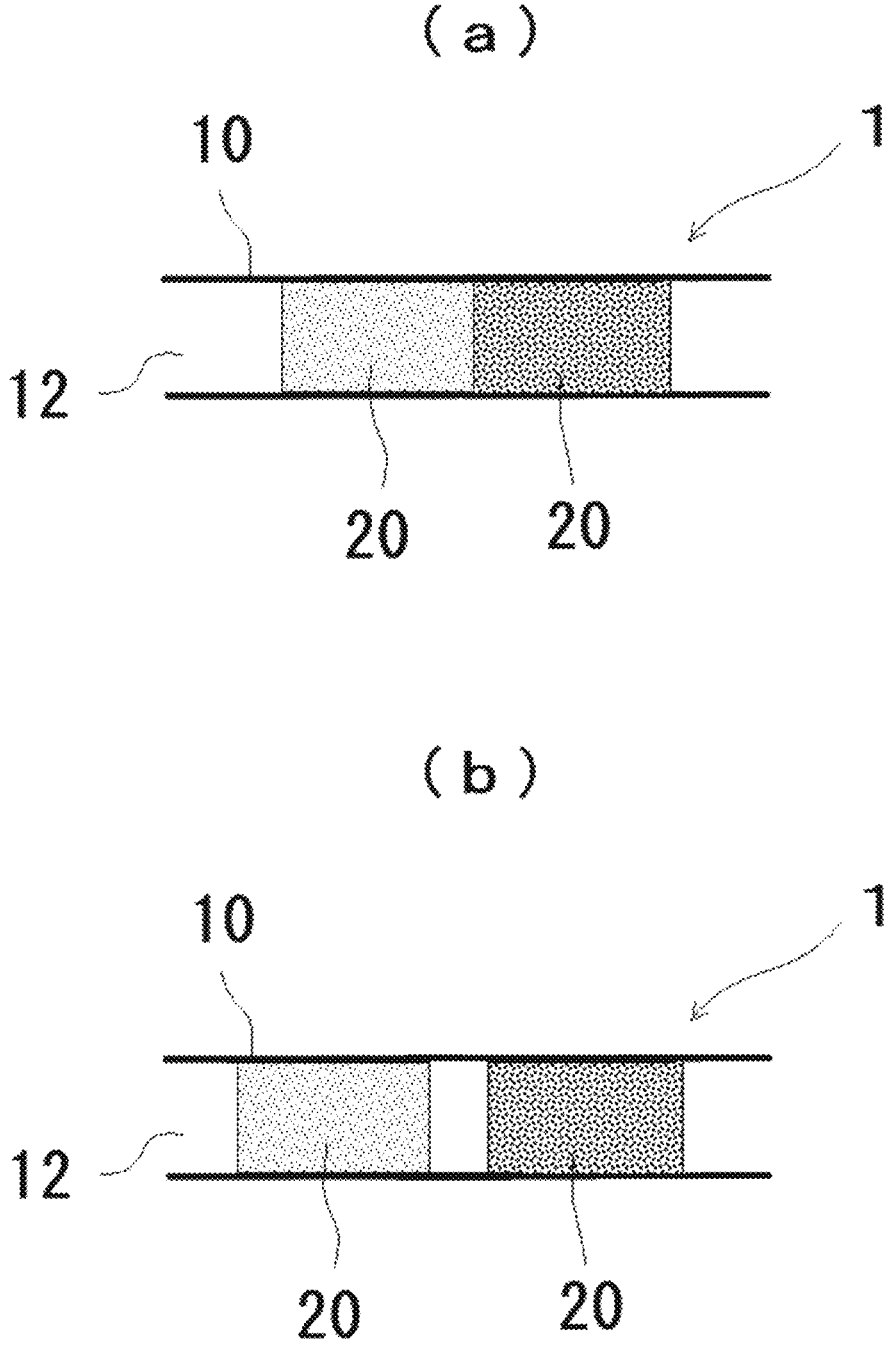
FIG. 2 A cross-sectional view showing an embodiment of the flow path tube according to the present invention (Embodiment 1)

FIGS. 1 and 2 are cross-sectional views showing Embodiment 1 of the flow path tube 1 according to the present invention.

In other words, the flow path tube 1 according to this embodiment comprises the porous materials 20 at given positions within the tube channel 12 of the flow path tube body 10.

The material of the flow path tube 1 is not particularly restricted to metals or synthetic resins. The flow path tube 1 is made of, for example, LDPE (low density polyethylene). HDPE (high density polyethylene), fluororesin, nylon, polypropylene, PEEK (polyether ether ketone), or the like.

The porous material 20 is formed by a sintered body or foam of resin (polyethylene resin, polypropylene resin, polyurethane resin, phenol resin, polyvinyl chloride resin, urea resin, silicone resin, fluororesin, polyimide resin, and melamine resin) or ceramic or metal, has a continuous void structure and a necessary length, and has a necessary diametrical dimension enabling insertion into the tube channel 12 of the flow path tube body 10. The continuous void structure refers to an aggregate of many objects joined with many small regular or irregular interspaces and the interspaces are termed "pores." As the pores are present in the porous material 20, the pores function as the flow path of fluids (a liquid and a gas) in the present invention.

The pores of the above porous material 20 are stereoscopic pores, have various shapes including not only round but also nearly polyhedral shapes, and are intricate and mutually connected. The fluids (a liquid and a gas) that flow through the pores as the flow path do not form a constant flow from entrance to exit, flowing while repeatedly diverging and converging. In the course of such a complex flow, the fluids (a liquid and a gas) are repeatedly stirred and mixed, in other words the pores act to stir and mix the fluids (a liquid and a gas) that flow through them.

The length of the porous material 20 is not particularly restricted. However, this length is determined as appropriate in consideration of the flow rate and the degree of stirring and mixing of the fluids (a liquid and a gas) because these are subject to change depending on the magnitude of the length. Moreover, the diametrical dimension of the porous material 20 is not particularly restricted as long as the porous material 20 is insertable into the tube channel 12 of the flow path tube body 10. However, it is preferable that the porous material 20 stays at the insertion position even if it is subject to the fluid pressure of the fluids (a liquid and a gas) and it is desirable that the porous material 20 has a diametrical dimension nearly equal to or slightly larger than the diameter of the tube channel 12.

The diameter of the pores of the porous material 20 is not particularly restricted. However, it is preferable that this diameter is generally 10 to 300 μm or so, preferably 20 to 120 μm, and further preferably 40 to 100 μm. The diameter of the pores is set with the view of the flow rate of and the stirring and mixing action on the fluids (a liquid and a gas). The diameter smaller than 10 μm may inhibit the flow of the fluids (a liquid and a gas). Conversely, the diameter larger than 300 μm may fail to entirely uniformly stir and mix the fluids (a liquid and a gas). In that sense, it is possible to adjust the flow rate and the degree of stirring and mixing by the magnitude of the diameter of the pores.

Here, multiple pores present in a porous material 20 do not have an equal diameter. In other words, a porous material 20 is formed as an aggregate of pores having different diameters. Therefore, as described above, the diameter of the pores is generally within a range of 10 to 300 μm or so.

The porosity (void volume) of the porous material 20 is not particularly restricted either and is preferably 30 to 80% or so in general. The porosity (void volume) refers to the ratio of the cross-sectional area to the total cross-sectional area in a certain cross-section. Translated to the present invention, the porosity (void volume) is the ratio of the occupancy of pores in a given cross-section of the porous material 20 to the cross-sectional area of the tube channel 12. The porosity (void volume) relates to the magnitude of the diameter of the pores and is set with the view of the flow rate of and the stirring and mixing action on the fluids (a liquid and a gas). The porosity (void volume) lower than 30% is excessively low and may inhibit the flow of the fluids (a liquid and a gas). Conversely, the porosity (void volume) higher than 80% is excessively high and may fail to entirely uniformly stir and mix the fluids (a liquid and a gas). In that sense, it is possible to adjust the flow rate and the degree of stirring and mixing by the magnitude of the porosity (void volume).

Here, the porosity (void volume) of a porous material 20 is not equal in all cross-sections. A porous material 20 is formed as an aggregate of cross-sections having different porosities (void volumes) in relation to the magnitude of the diameter of the pores. Therefore, as described above, the porosity (void volume) is generally within a range of 30 to 80% or so.

As described above, the porous material 20 has the length, the pore diameter, and the porosity (void volume) each having the function of adjusting the flow rate and the degree of stirring and mixing of the fluids (a liquid and a gas) and set as appropriate for synergistically adjusting the flow rate and the degree of stirring and mixing.

The porous material 20 is inserted into the tube channel 12 of the flow path tube body 10 and disposed at a given position within the tube channel 12. The position at which the porous material 20 is disposed within the tube channel 12 is not particularly restricted and can be any position. In this regard, a single porous material 20 is disposed within the tube channel 12 in one mode as shown in FIG. 1, and two porous materials 20 may be disposed within the tube channel 12 in another mode as shown in FIGS. 2 (*a*) and (*b*). Any number of porous materials 20 can be disposed within the tube channel 12. The number of porous materials 20 to dispose is determined as appropriate in consideration of the flow rate and the degree of stirring and mixing of the fluids (a liquid and a gas) because these are subject to change depending on the number of porous materials 20. Here, when multiple porous materials 20 are disposed, the porous materials 20 may be disposed next to each other as shown in FIG. 2 (*a*) or the porous materials 20 may be disposed with a space in-between as shown in FIG. 2 (*b*). Moreover, a mode in which the porous materials 20 different in length, pore diameter, and/or porosity (void volume) are disposed is conceivable.

In inserting and disposing the porous material 20 within the tube channel 12, given a diametrical dimension equal to or larger than the diameter of the tube channel 12 as described above, the porous material 20 does not move within the tube channel 12 even if it is subject to the fluid pressure of the fluids (a liquid and a gas). However, in order to ensure that, it is conceivable to insert the porous material 20 with adhesive applied on the outer periphery. This is particularly effective when the diametrical dimension of the porous material 20 is slightly smaller than the diameter of the tube channel 12 in consideration of insertability.

The flow path tube 1 according to this embodiment having the above configuration comprises the porous material 20 disposed at a given position within the tube channel 12 of the flow path tube body 10, whereby the porous material 20 is disposed to block the tube channel 12. As a result, the pores of the porous material 20 having a continuous void structure function as the flow path of the fluids (a liquid and a gas), the flow rate is adjustable by the length, pore diameter, and porosity (void volume) of the porous material 20, and the entire porous material 20 functions as a valve.

Moreover, when flowing through the pores of the porous material 20 as the flow path, the fluids (a liquid and a gas) repeatedly diverge and converge and form a complex flow, in the course of which the fluids (a liquid and a gas) are repeatedly stirred and mixed.

As described above, the flow path tube 1 according to this embodiment makes it possible to reliably stir and entirely uniformly mix the fluids (a liquid and a gas) that flow within the tube channel 12, prevent foreign substances from flowing out by the filtering effect of the porous material 20, and furthermore adjust the flow rate.

Embodiment 2

Figure 3:
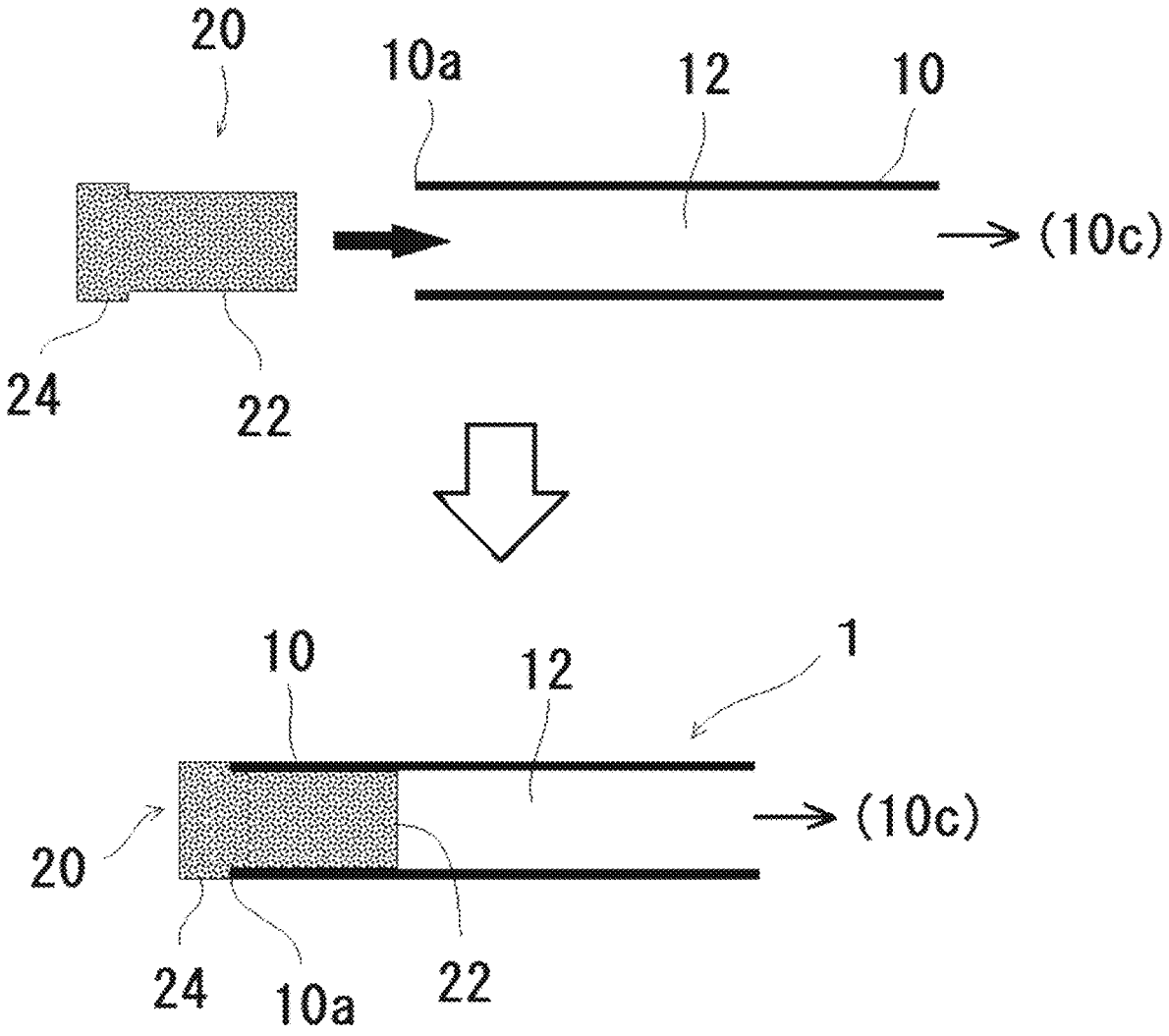
FIG. 3 A cross-sectional view showing an embodiment of the flow path tube according to the present invention (Embodiment 2)
Figure 4:
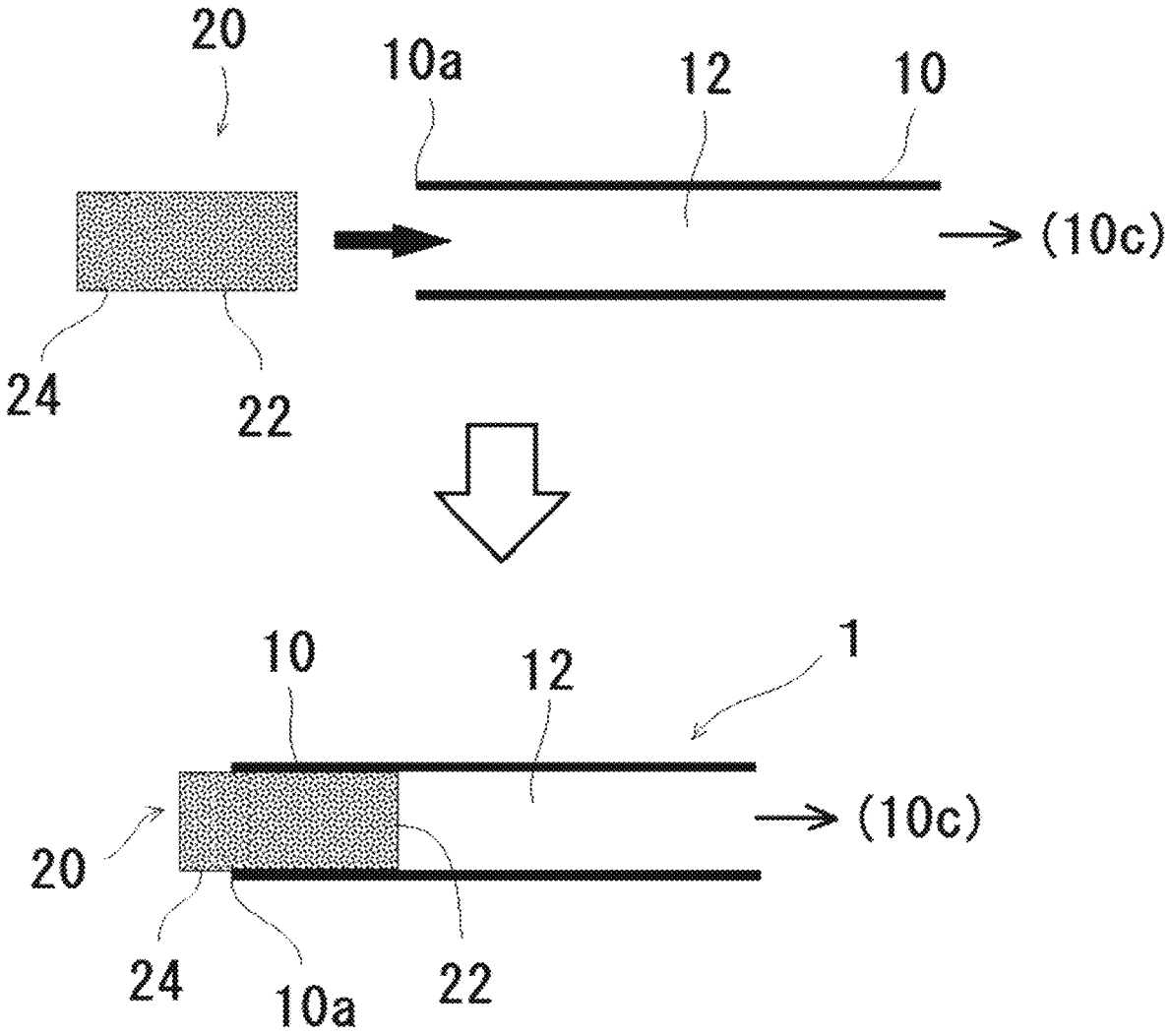
FIG. 4 A cross-sectional view showing an embodiment of the flow path tube according to the present invention (Embodiment 2)

FIGS. 3 and 4 are cross-sectional views showing Embodiment 2 of the flow path tube 1 according to the present invention.

In other words, the flow path tube 1 according to this embodiment comprises the porous material 20 within the tube channel 12 of the flow path tube body 10 and is different from the above Embodiment 1 in that the porous material 20 comprises an insert part 22 that is inserted into the tube channel 12 and a leading end part 24 that is not inserted into the tube channel 12 and exposed and that the insert part 22 of the porous material 20 is inserted from an leading end 10*a* of the flow path tube body 10 and fixed within the tube channel 12.

The porous material 20 comprises the insert part 22 and the leading end part 24. The insert part 22 has a necessary length and a necessary diametrical dimension enabling insertion into the tube channel 12 of the flow path tube body 10. The length of the insert pan 22 is not particularly restricted. However, this length is determined as appropriate in consideration of the flow rate and the degree of stirring and mixing of the fluids (a liquid and a gas) because these are subject to change depending on the magnitude of the entire length of the porous material 20 including the leading end part 24. Moreover, the diametrical dimension of the insert part 22 is not particularly restricted as long as it is insertable into the tube channel 12 of the flow path tube body 10. However, it is desirable that the diametrical dimension is equal to or slightly larger than the diameter of the tube channel 12 so that the insert part 22 stays at the insertion position even if it is subject to the fluid pressure of the fluids (a liquid and a gas).

The leading end part 24 has a necessary length and a necessary diametrical dimension. The length of the leading end part 24 is not particularly restricted either. However, this length is determined as appropriate in consideration of the flow rate and the degree of stirring and mixing of the fluids (a liquid and a gas) because these are subject to change depending on the magnitude of the entire length of the porous material 20 including the insert part 22.

The diametrical dimension of the leading end part 24 is not particularly restricted and can be determined on an arbitrary basis to be larger or smaller than the diametrical dimension of the insert part 22. In this regard, for example as shown in FIG. 3, it is conceivable that given a diametrical dimension larger than the insert part 22, the leading end part 24 has a step at their boundary by its diametrical dimension. As a result, using the step, easy positioning during the insertion can be assured by inserting the insert part 22 into the tube channel 12 from the leading end 10*a* of the flow path tube body 10, making the leading end 10*a* of the flow path tube body 10 abut against the step, and fixing the porous material 20 to the flow path tube body 10 in that state.

Here, FIG. 3 shows the case in which the diametrical dimension of the leading end part 24 is equal to the outer diametrical dimension of the flow path tube body 10. Using such a mode, the outer periphery of the leading end part 24 of the porous material 20 and the outer periphery of the flow path tube body 10 are formed on an even plane with no step.

Moreover, in regard to the diametrical dimension of the leading end part 24, for example as shown in FIG. 4, it is conceivable that the diametrical dimension of the leading end part 24 is equal to the diametrical dimension of the insert part 22. As a result, the outer peripheries of the insert part 22 and the leading end part 24 are on an even plane with no step. In other words, the porous material 20 can be formed into a rod shape, whereby easy manufacturing of the porous material 20 is assured.

In inserting and fixing the insert part 22 of the porous material 20 within the tube channel 12, the insert part 22 having a diametrical dimension equal to or slightly larger than the diameter of the tube channel 12 as described above does not come off from the tube channel 12 even if it is subject to the fluid pressure of the fluids (a liquid and a gas). However, in order to ensure that, it is conceivable to insert the insert part 22 with adhesive applied on the outer periphery. This is particularly effective when the diametrical dimension of the insert part 22 is slightly smaller than the diameter of the tube channel 12 in consideration of insertability.

Here, other structures and configurations of the flow path tube 1 and the porous material 20 according to this embodiment are the same as those of the above Embodiment 1 and thus their explanation is omitted.

In the flow path tube 1 according to this embodiment having the above configuration, the porous material 20 is fixed to the leading end 10*a* of the flow path tube body 10 and thus the porous material 20 is disposed to block the leading end 10*a* of the tube channel 12. As a result, the pores of the porous material 20 having a continuous void structure function as the flow path of the fluids (a liquid and a gas), the flow rate is adjustable by the length, pore diameter, and porosity (void volume) of the porous material 20, and the entire porous material 20 functions as a valve.

Moreover, when flowing through the pores of the porous material 20 as the flow path, the fluids (a liquid and a gas) repeatedly diverge and converge and form a complex flow, in the course of which the fluids (a liquid and a gas) are repeatedly stirred and mixed.

As described above, the flow path tube 1 according to this embodiment makes it possible to reliably stir and entirely uniformly mix the fluids (a liquid and a gas) that flow within the tube channel 12, prevent foreign substances from flowing in/flowing out by the filtering effect of the porous material 20, and furthermore adjust the flow rate.

Embodiment 3

Figure 5:
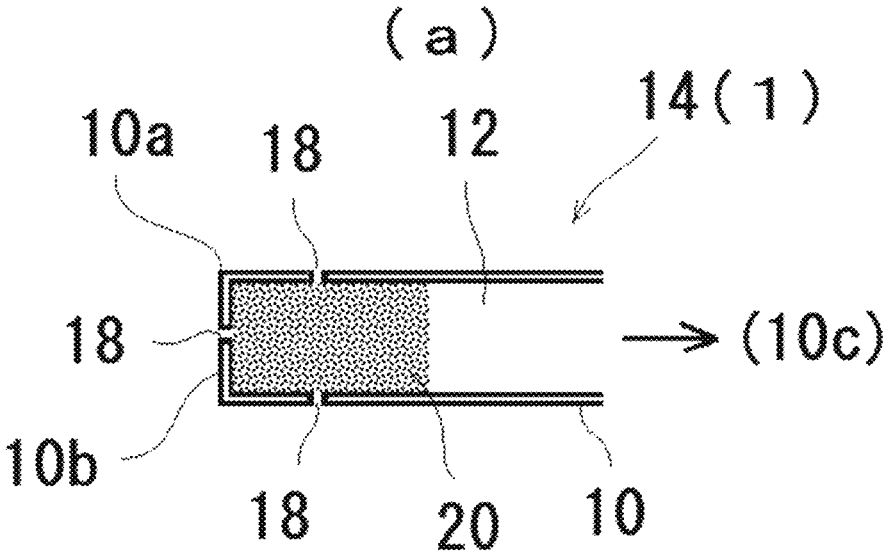
FIG. 5 A cross-sectional view showing an embodiment of the jet nozzle tube according to the present invention (Embodiment 3)
Figure 5:
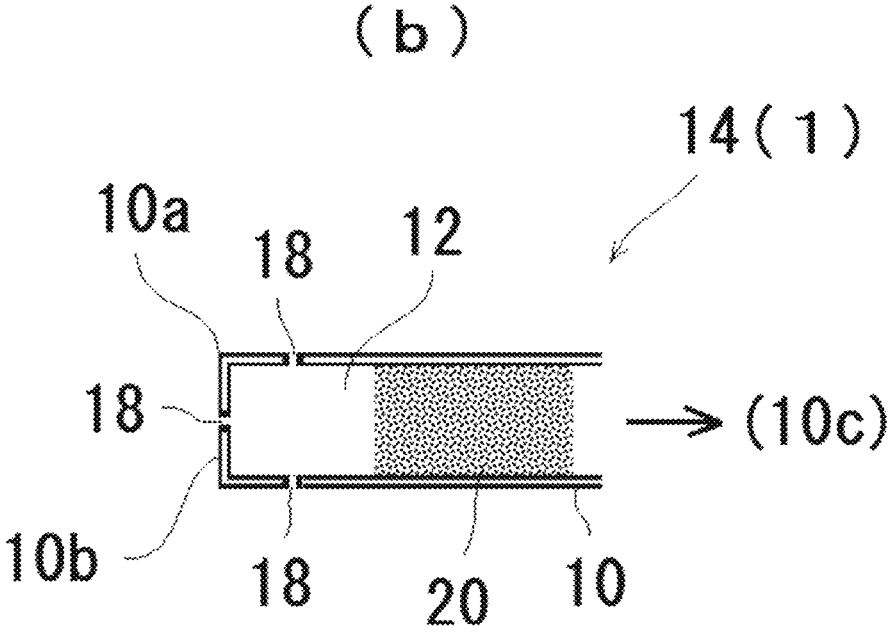

FIG. 5 is a cross-sectional view showing a first embodiment of the jet nozzle tube 14 according to the present invention.

In other words, the jet nozzle tube 14 according to this embodiment uses the flow path tube 1 according to the above Embodiment 1, namely the flow path tube 1 comprising the porous material 20 at a given position within the tube channel 12, in which ejection holes 18 are formed at given positions in the flow path tube body 10.

Here, the jet nozzle tube 14 is the flow path tube 1 that is connected at the base end 10*c* to a valve body provided at the upper end of a spray can or an aerosol can and comprises the ejection holes 18 near the leading end 10*a* for ejecting the content of the spray or aerosol can from the ejection holes 18.

The flow path tube body 10 according to this embodiment is closed at the leading end 10*a* and sprays the fluids (a liquid and a gas) from the formed ejection holes 18. The ejection holes 18 are formed in either one or both of the closed, leading end face 10*b* and the outer periphery near the leading end 10*a* of the flow path tube body 10, and thus at least one or more ejection holes 18 are formed in the flow path tube body 10. Here, the number of ejection holes 18 has only to be determined as appropriate according to the mode of use of the jet nozzle tube 14 according to this embodiment.

The positions at which the ejection holes 18 are formed are not particularly restricted. However, the ejection holes 18 are formed closer to the leading end 10*a* than the porous material 20 including at least the position at which the porous material 20 is disposed. This is because even if the ejection holes 18 are formed in the flow path tube body 10 closer to the base end 10*c* than the position at which the porous material 20 is disposed, the fluids (a liquid and a gas) are ejected from the ejection holes 18 before the effect of the stirring and mixing action is obtained.

The position at which the porous material 20 is disposed within the jet nozzle tube 14 according to this embodiment is not particularly restricted like the flow path tube 1 according to Embodiment 1. However, it is preferable to dispose the porous material 20 in contact with the formed ejection holes 18 or near the ejection holes 18 in order to spray the fluids (a liquid and a gas) that have passed through the porous material 20 and been stirred and mixed from the ejection holes 18 in mist. It is desirable to dispose the porous material 20 next to the closed, leading end 10*a* (the leading end face 10*b*) within the tube channel 12 of the flow path tube body 10 as shown in FIG. 5 (*a*) or dispose the porous material 20 near the leading end 10*a* at a given distance from the leading end 10*a* (the leading end face 10*b*) as shown in FIG. 5 (*b*).

In the jet nozzle tube 14 according to this embodiment having the above configuration, the porous material 20 is disposed at a given position within the tube channel 12 of the flow path tube body 10, whereby the porous material 20 is disposed to block the tube channel 12. As a result, the pores of the porous material 20 having a continuous void structure function as the flow path of the fluids (a liquid and a gas), the flow rate is adjustable by the length, pore diameter, and porosity (void volume) of the porous material 20, and the entire porous material 20 functions as a valve.

Moreover, when flowing through the pores of the porous material 20 as the flow path, the fluids (a liquid and a gas) repeatedly diverge and converge and form a complex flow, in the course of which the fluids (a liquid and a gas) are repeatedly stirred and mixed.

As described above, the jet nozzle tube 14 according to this embodiment makes it possible to prevent the ejection holes 18 from being clogged with foreign substances by the filtering effect of the porous material 20, enable stable and constant ejection by the stirring and mixing action on the fluids (a liquid and a gas) that flow within the tube channel 12, and furthermore realize an entirely uniformly mixed state of the fluids (a liquid and a gas), whereby it is possible to spray the content of a spray can or an aerosol can in perfect mist to the extent of floating in the air.

Embodiment 4

Figure 6:
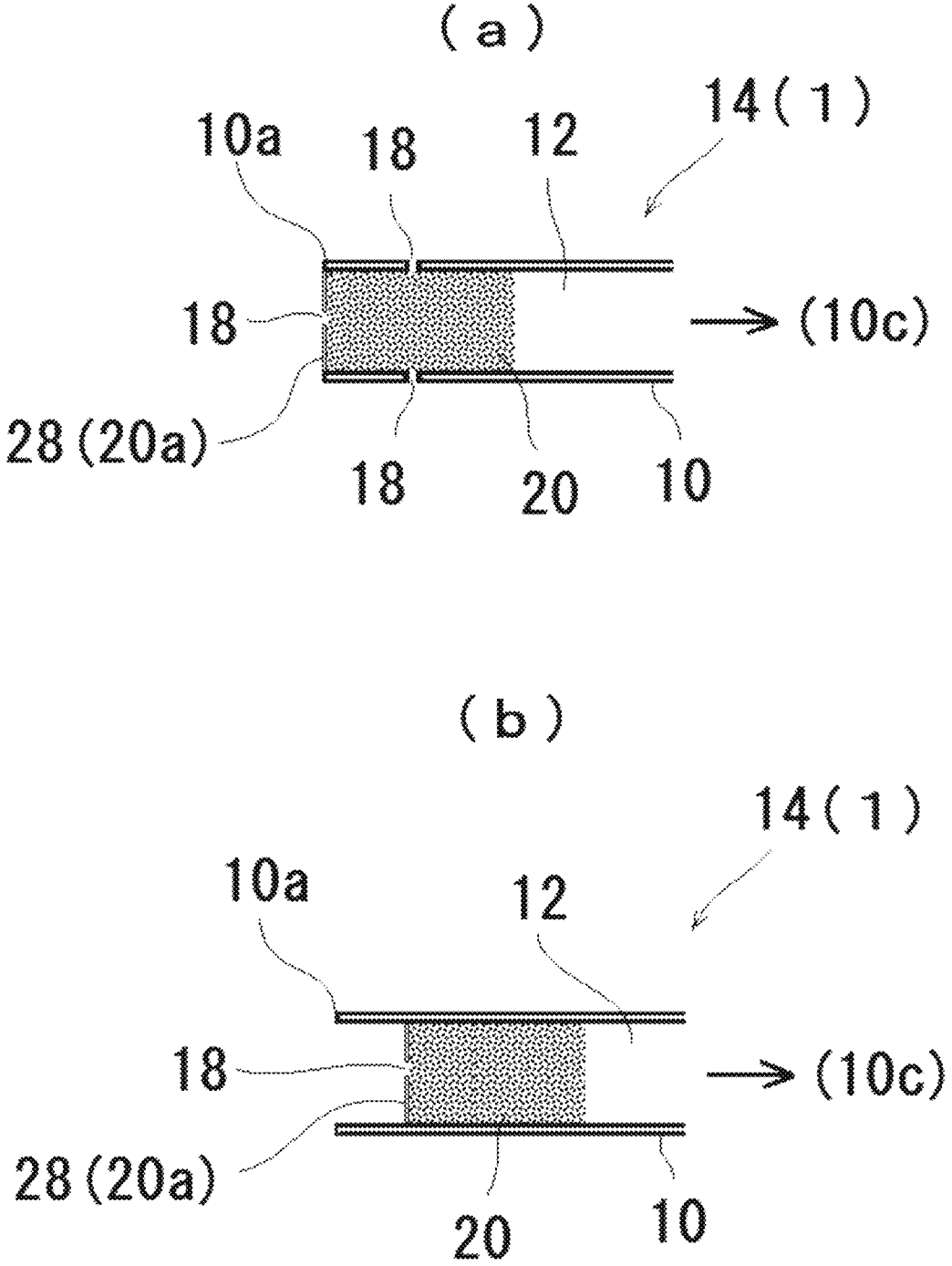
FIG. 6 A cross-sectional view showing an embodiment of the jet nozzle tube according to the present invention (Embodiment 4)

FIG. 6 is a cross-sectional view showing a second embodiment of the jet nozzle tube 14 according to the present invention.

In other words, the jet nozzle tube 14 according to this embodiment uses the flow path tube 1 according to the above Embodiment 1, namely the flow path tube 1 comprising the porous material 20 at a given position within the tube channel 12, in which the ejection holes 18 are formed at given positions in the porous material 20 and the flow path tube body 10.

Here, the jet nozzle tube 14 is the flow path tube 1 that is connected at the base end 10*c* to a valve body provided at the upper end of a spray can or an aerosol can and comprises the ejection holes 18 near the leading end 10*a* for ejecting the content of the spray or aerosol can from the ejection holes 18.

The flow path tube body 10 according to this embodiment is opened at the leading end 10*a*, comprises, at a given position within the tube channel 12, the porous material 20 having a leading end face 20*a* on which a resin material is applied, and has the ejection holes 18 formed as necessary in the outer periphery at the position at which the porous material 20 is disposed.

The resin material on the leading end face 20*a* of the porous material 20 forms a coating 28 for the purpose of sealing. The applied resin material is not particularly restricted and conceivably, for example, polyvinyl chloride resin, fluororesin, acrylic resin, and epoxy resin. As just stated, the resin material applied on the leading end face 20*a* of the porous material 20 to form the coating 28 seals the leading end face 20*a* of the porous material 20 and prevents the fluids (a liquid and a gas) from being ejected from other than the formed ejection holes 18.

The ejection holes 18 according to this embodiment are formed in either one or both of the leading end face 20*a* of the porous material 20 on which the coating 28 is formed and the outer periphery of the flow path tube body 10 at the position at which the porous material 20 is disposed, and thus at least one or more ejection holes 18 are formed in the porous material 20 or in the flow path tube body 10. Here, the number of the ejection holes 18 has only to be determined as appropriate according to the mode of use of the jet nozzle tube 14 according to this embodiment.

As described above, the positions at which the ejection holes 18 are formed are not particularly restricted and either in the leading end face 20*a* of the porous material 20 or in the outer periphery of the flow path tube body 10. However, if anything, it is desirable to form the ejection holes 18 in the leading end face 20*a* of the porous material 20 because the resin coating 28 is generally thinner than the flow path tube body 10 and flexible, thereby facilitating the process of forming the ejection holes 18.

The position at which the porous material 20 is disposed within the jet nozzle tube 14 according to this embodiment is not particularly restricted like the flow path tube 1 according to Embodiment 1. However, it is desirable to dispose the porous material 20 next to the leading end 10*a* within the tube channel 12 of the flow path tube body 10 as shown in FIG. 6 (*a*) or dispose the porous material 20 near the leading end 10*a* at a given distance from the leading end 10*a* as shown in FIG. 6 (*b*) in order to spray the fluids (a liquid and a gas) that have passed through the porous material 20 and been stirred and mixed from the ejection holes 18 in mist.

In the jet nozzle tube 14 according to this embodiment having the above configuration, the porous material 20 is disposed at a given position within the tube channel 12 of the flow path tube body 10, whereby the porous material 20 is disposed to block the tube channel 12. As a result, the pores of the porous material 20 having a continuous void structure function as the flow path of the fluids (a liquid and a gas), the flow rate is adjustable by the length, pore diameter, and porosity (void volume) of the porous material 20, and the entire porous material 20 functions as a valve.

Moreover, when flowing through the pores of the porous material 20 as the flow path, the fluids (a liquid and a gas) repeatedly diverge and converge and form a complex flow, in the course of which the fluids (a liquid and a gas) are repeatedly stirred and mixed.

As described above, the jet nozzle tube 14 according to this embodiment makes it possible to prevent the ejection holes 18 from being clogged with foreign substances by the filtering effect of the porous material 20, enable stable and constant ejection by the stirring and mixing action on the fluids (a liquid and a gas) that flow within the tube channel 12, and furthermore realize an entirely uniformly mixed state of the fluids (a liquid and a gas), whereby it is possible to spray the content of a spray can or an aerosol can in perfect mist to the extent of floating in the air.

Embodiment 5

Figure 7:
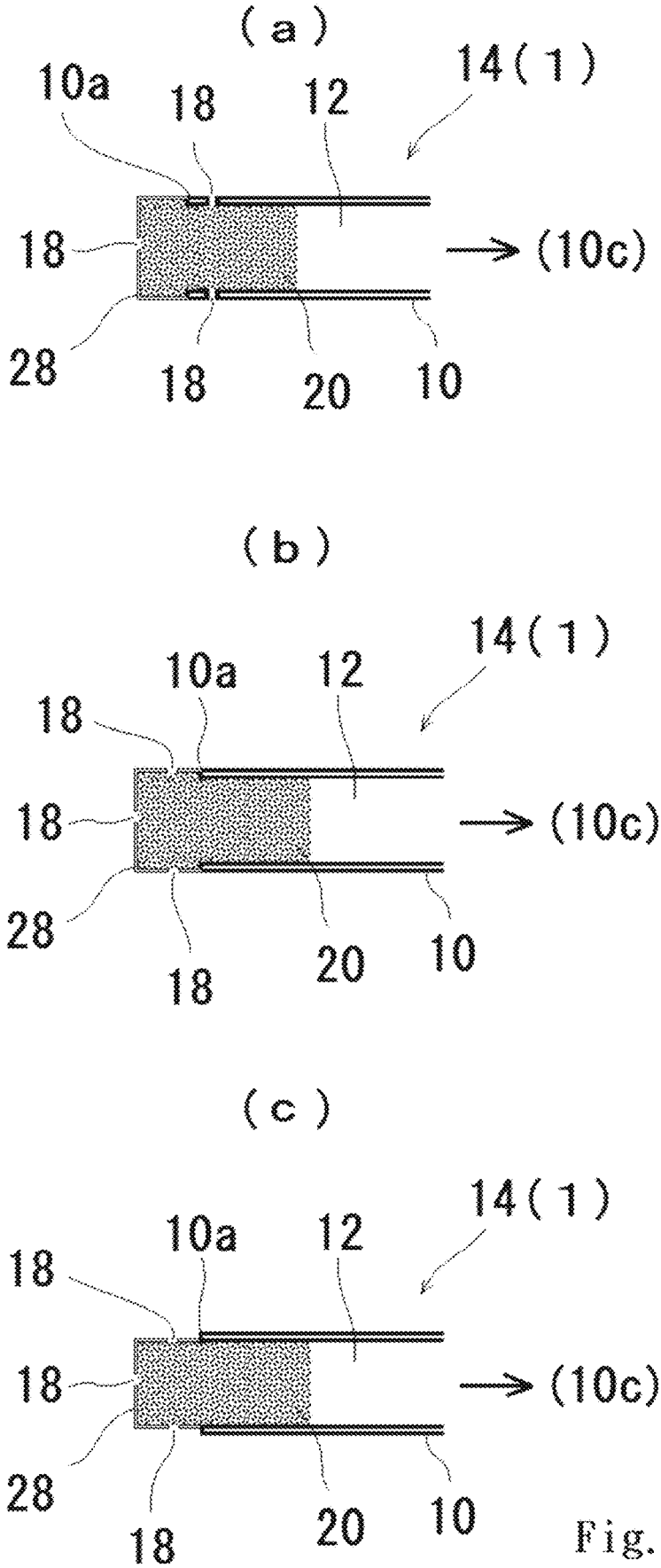
FIG. 7 A cross-sectional view showing an embodiment of the jet nozzle tube according to the present invention (Embodiment 5)

FIG. 7 is a cross-sectional view showing a third embodiment of the jet nozzle tube 14 according to the present invention, in which (a) and (b) show the case in which the diametrical dimension of the leading end part 24 of the porous material 20 is larger than the insert part 22 to form a step and (c) shows the case in which the diametrical dimension of the leading end part 24 is equal to the insert part 22.

In other words, the jet nozzle tube 14 according to this embodiment uses the flow path tube 1 according to the above Embodiment 2, namely the flow path tube 1 comprising the porous material 20 that is fixed to the leading end 10*a* of the flow path tube body 10, in which the ejection holes 18 are formed at given positions in the leading end part 24 of the porous material 20 or in the flow path tube body 10.

Here, the jet nozzle tube 14 is the flow path tube 1 that is connected at the base end 10*c* to a valve body provided at the upper end of a spray can or an aerosol can and comprises the ejection holes 18 near the leading end 10*a* for ejecting the content of the spray or aerosol can from the ejection holes 18.

A resin material is applied to the outer surface of the leading end part 24 of the porous material 20 according to this embodiment to form the coating 28. The applied resin material is not particularly restricted and conceivably, for example, polyvinyl chloride resin, fluororesin, acrylic resin, and epoxy resin. As just stated, the resin material applied to the outer surface of the leading end part 24 of the porous material 20 to form the coating 28 seals the leading end part 24 of the porous material 20 and prevents the fluids (a liquid and a gas) from being ejected from other than the formed ejection holes 18.

The ejection holes 18 according to this embodiment are formed in either one or both of the outer surface of the leading end part 24 of the porous material 20 on which the coating 28 is formed and the outer periphery of the flow path tube body 10 near the leading end 10*a*, and thus at least one or more ejection holes 18 are formed in the porous material 20 or in the flow path tube body 10. Here, the number of the ejection holes 18 has only to be determined as appropriate according to the mode of use of the jet nozzle tube 14 according to this embodiment.

In the case of forming the ejection holes 18 in the outer periphery of the flow path tube body 10 near the leading end 10*a*, as shown in FIG. 7 (*a*), the ejection holes 18 are formed in the outer periphery at the position at which the porous material 20 is disposed, namely at the position where the insert part 22 of the porous material 20 is present. This is because even if the ejection holes 18 are formed in the flow path tube body 10 closer to the base end 10*c* than the position at which the porous material 20 is disposed, the fluids (a liquid and a gas) are ejected from the ejection holes 18 before the effect of the stirring and mixing action is obtained.

As described above, the positions at which the ejection holes 18 are formed are not particularly restricted and either in the outer surface of the leading end part 24 of the porous material 20 or in the outer periphery of the flow path tube body 10. However, preferably, it is desirable to form the ejection holes 18 in the outer surface of the leading end part 24 of the porous material 20 because the resin coating 28 is generally thinner than the flow path tube body 10 and flexible, thereby facilitating the process of forming the ejection holes 18. Here, FIGS. 7 (*b*) and (*c*) show the case in which the ejection holes 18 are formed only in the outer surface of the leading end part 24 of the porous material 20.

In the jet nozzle tube 14 according to this embodiment having the above configuration, the porous material 20 is fixed at the leading end 10*a* of the flow path tube body 10, whereby the porous material 20 is disposed to block the leading end 10*a* of the tube channel 12. As a result, the pores of the porous material 20 having a continuous void structure function as the flow path of the fluids (a liquid and a gas), the flow rate is adjustable by the length, pore diameter, and porosity (void volume) of the porous material 20, and the entire porous material 20 functions as a valve.

Moreover, when flowing through the pores of the porous material 20 as the flow path, the fluids (a liquid and a gas) repeatedly diverge and converge and form a complex flow, in the course of which the fluids (a liquid and a gas) are repeatedly stirred and mixed.

As described above, the jet nozzle tube 14 according to this embodiment makes it possible to prevent the ejection holes 18 from being clogged with foreign substances by the filtering effect of the porous material 20, enable stable and constant ejection by the stirring and mixing action on the fluids (a liquid and a gas) that flow within the tube channel 12, and furthermore realize an entirely uniformly mixed state of the fluids (a liquid and a gas), whereby it is possible to spray the content of a spray can or an aerosol can in perfect mist to the extent of floating in the air.

Embodiment 6

Figure 8:
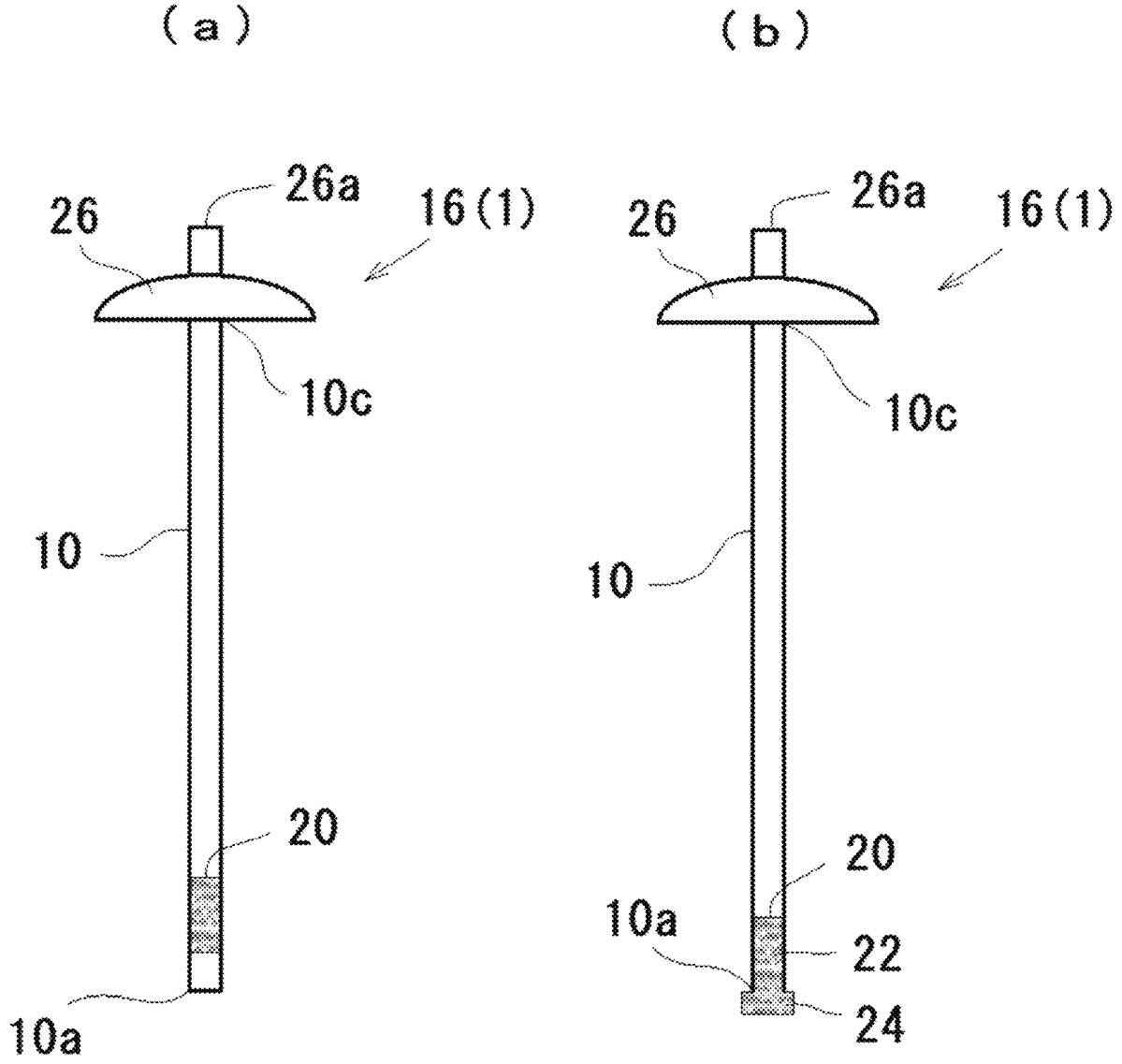
FIG. 8 An explanatory illustration showing an embodiment of the aerosol valve tube according to the present invention (Embodiment 6).

FIG. 8 is an explanatory illustration showing an embodiment of the aerosol valve tube 16 according to the present invention.

In other words, the aerosol valve tube 16 according to this embodiment uses the flow path tube 1 according to the above Embodiment 1 or Embodiment 2, namely the flow path tube 1 comprising the porous material 20 at a given position within the tube channel 12 or the flow path tube 1 comprising the porous material 20 that is fixed to the leading end 10*a* of the flow path tube body 10, in which a valve body 26 is attached to the base end 10*c* of the flow path tube body 10.

Here, the aerosol valve tube 16 is the flow path tube 1 to the base end 10*c* of which the valve body 26 is connected and the leading end 10*a* of which is disposed in a spray can or an aerosol can for ejecting the content of the spray or aerosol can from the valve body 26.

FIG. 8 (*a*) shows an embodiment of the aerosol valve tube 16 using the flow path tube 1 according to Embodiment 1. In the aerosol valve tube 16 according to this embodiment, the valve body 26 is attached to the base end 10*c* of the flow path tube body 10 having the porous material 20 inserted and disposed at a given position within the tube channel 12.

FIG. 8 (*b*) shows an embodiment of the aerosol valve tube 16 using the flow path tube 1 according to Embodiment 2. In the aerosol valve tube 16 according to this embodiment, the valve body 26 is attached to the base end 10*c* of the flow path tube body 10 having the porous material 20 fixed at the leading end 10*a*.

The position at which the porous material 20 is disposed in the aerosol valve tube 16 using the flow path tube 1 according to Embodiment 1 is not particularly restricted. However, it is preferable to dispose the porous material 20 near the leading end 10*a* within the tube channel 12 of the flow path tube body 10 in order to prevent foreign substances from entering the tube channel 12 by the filtering effect of the porous material 20.

The valve body 26 functions as an ejection outlet for ejecting the content of a spray can or an aerosol can and its detailed structure is not particularly restricted. The valve body 26 used in the prior art is sufficiently used and it is possible to adopt a structure to press from above to open the flow path and eject the content from an ejection outlet 26*a* by the gas pressure in the can.

In the aerosol valve tube 16 according to this embodiment having the above configuration, the porous material 20 is disposed at a given position within the tube channel 12 of the flow path tube body 10 or at the leasing end 10*a* of the flow path tube body 10, whereby the porous material 20 is disposed to block the tube channel 12. As a result, the pores of the porous material 20 having a continuous void structure function as the flow path of the fluids (a liquid and a gas), the flow rate is adjustable by the length, pore diameter, and porosity (void volume) of the porous material 20, and the entire porous material 20 functions as a valve.

Moreover, when flowing through the pores of the porous material 20 as the flow path, the fluids (a liquid and a gas) repeatedly diverge and converge and form a complex flow, in the course of which the fluids (a liquid and a gas) are repeatedly stirred and mixed.

As described above, the aerosol valve tube 16 according to this embodiment makes it possible to prevent foreign substances from entering the tube channel 12 by the filtering effect of the porous material 20 and enable stable and constant ejection by the stirring and mixing action on the fluids (a liquid and a gas) that flow within the tube channel 12.

Embodiment 7

In order to confirm the action/effect of the flow path tube 1 according to the present invention that are completed as in the above embodiments and the jet nozzle tube 14 and the aerosol valve tube 16 using the flow path tube 1, comparative experiments were conducted on the jet nozzle tube 14 according to the present invention and the jet nozzle tube according to the patent documents 1 and 2 previously proposed by the present applicant. Here, the prior art jet nozzle tube was one comprising a valve structure having a single through-hole of 0.2 mm in diametrical dimension and the jet nozzle tube 14 of the present invention was one using a polyethylene sintered body with pores of 60 to 100 μm as the porous material 20. In a comparative experiment, an aerosol can that contained hexane was used. Three valves and three porous materials 20 different in length were prepared. The time (seconds) required for ejecting 10 g was measured under the pressure that was changed to three different levels. The results of the experiment are shown below.

Figures 9, 10:
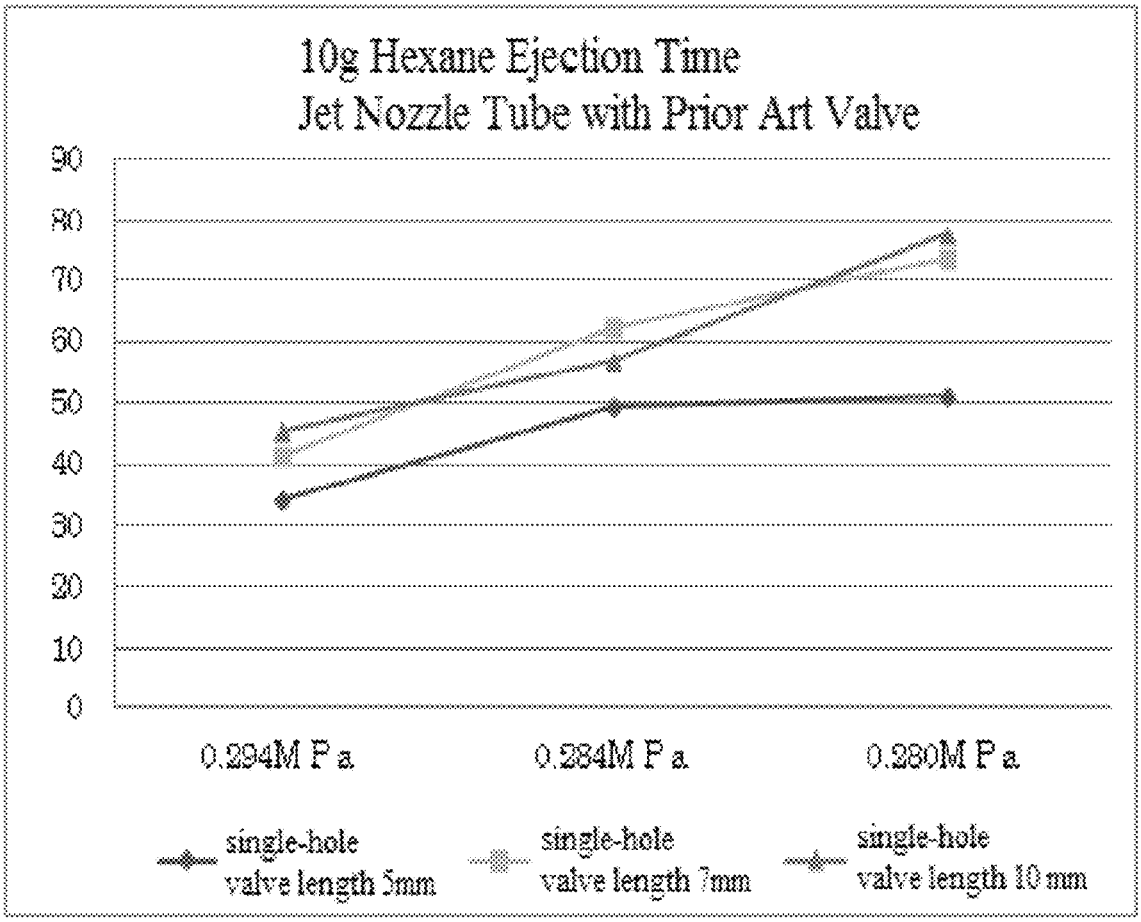
FIG. 9 is a list of the experimental results.
FIG. 10, FIG. 11, FIG. 12, FIG. 13 and FIG. 14 are graphical representations of the experimental results.
Figures 11, 12:
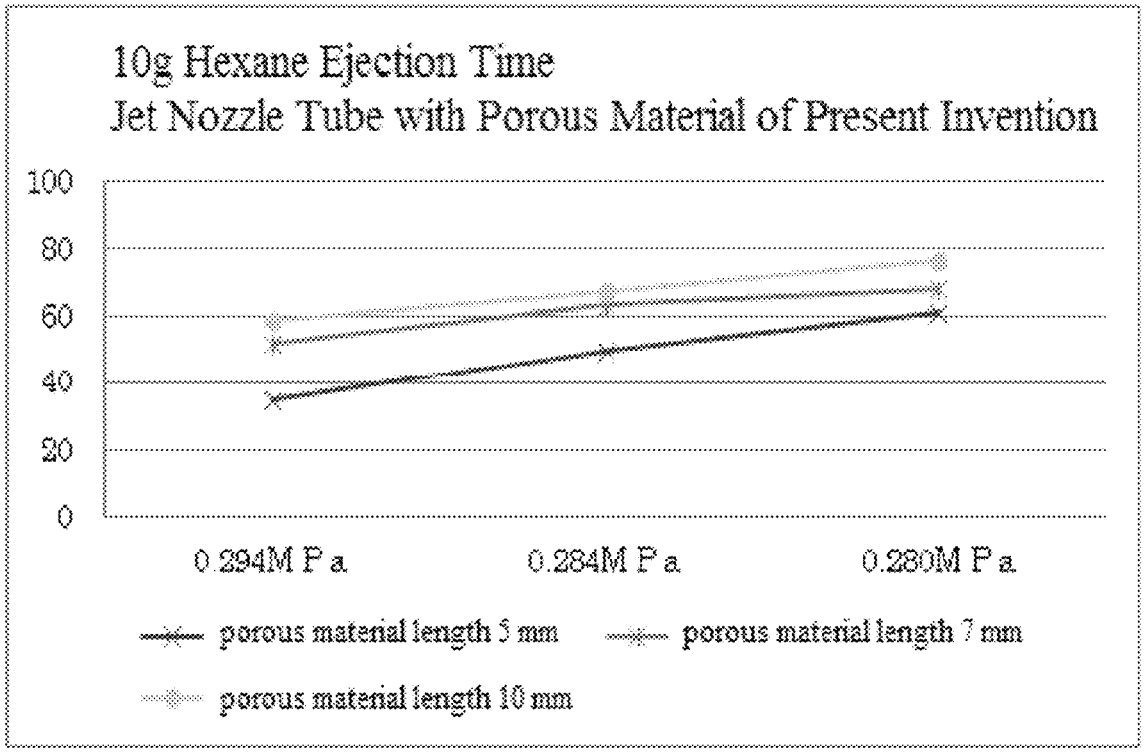
Figure 13:
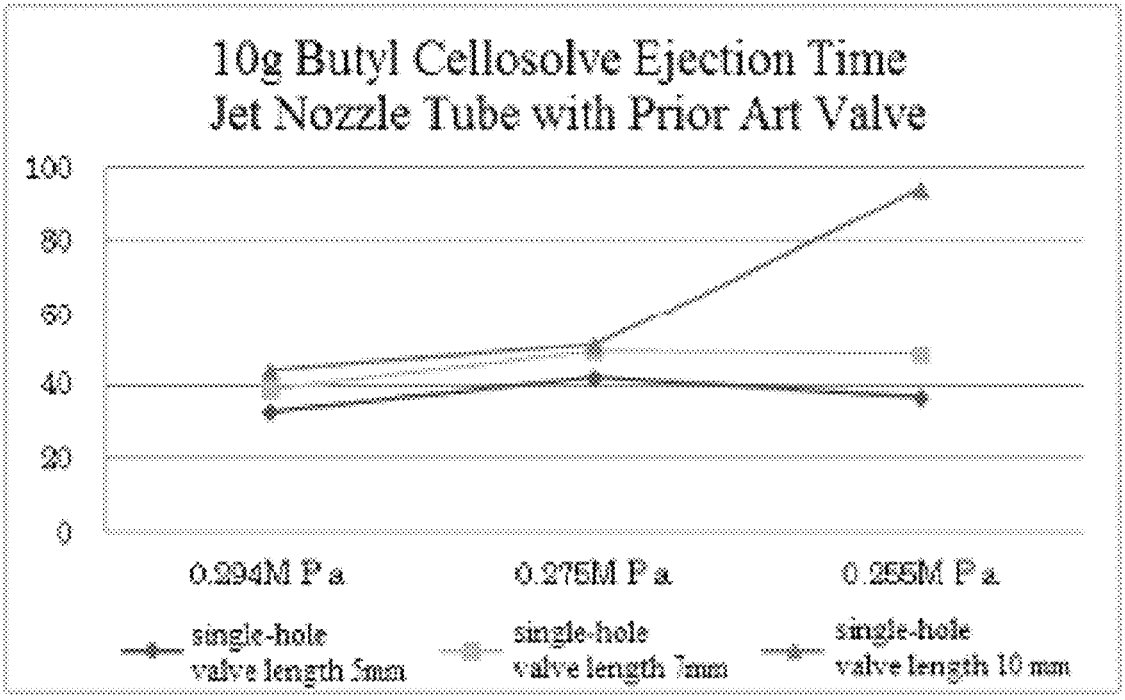
Figure 14:
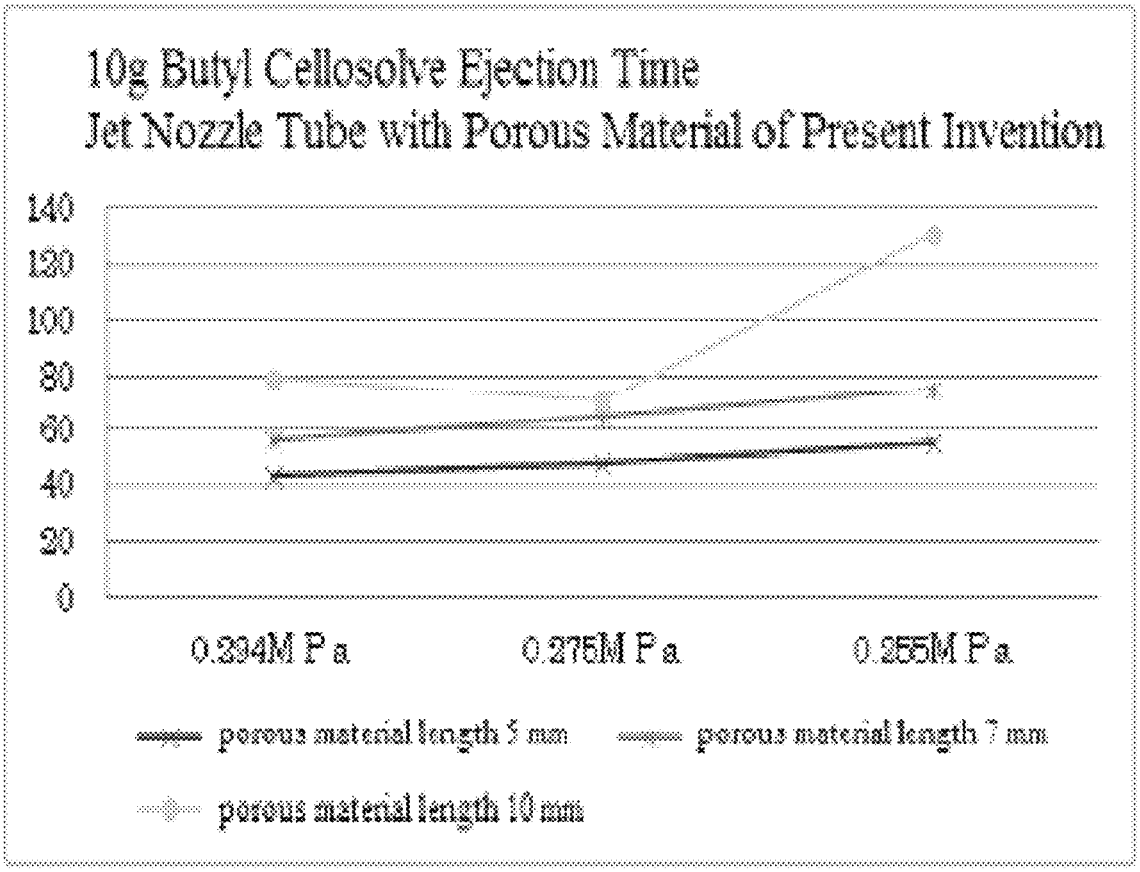

FIG. 9 is a list of the experimental results and FIGS. 10 and 12 are graphical representations of the experimental results.

As shown in FIGS. 9 and 10, it is understood that with the prior art jet nozzle tube, the mixed state of low-viscosity hexane and ejection gas significantly varied due to the pressure. Contrary, it is understood that with the jet nozzle tube 14 according to the present invention, the ejection state was stable compared with the prior art jet nozzle tube as shown in FIGS. 9 and 11.

Next, a comparative experiment using an aerosol can that contained butyl cellosolve was conducted on the jet nozzle tube 14 according to the present invention and the jet nozzle tube according to the patent documents 1 and 2 previously proposed by the present applicant under the same conditions as the above case of hexane. The results of this experiment are shown in the tables below.

FIG. 4 is a list of the experimental results and FIGS. 10 and 11 are graphical representation of the experimental results.

As shown in Tables 4 and 5, as for the mixed state of high-viscosity butyl cellosolve and ejection gas, the prior art jet nozzle tube comprising the 5-mm or 7-mm long valve exhibited the tendency of inverse-proportional ejection amount as in the case of low-viscosity hexane, and the one with the 10-mm long valve exhibited abrupt increase in resistance when the ejection pressure was low. Conversely, the jet nozzle tube 14 according to the present invention comprising the 5-mm or 7-mm long porous material 20 exhibited stable ejection characteristics as shown in Tables 4 and 6, and the one with the 10-mm long porous material 20 exhibited the flow rate change significantly influenced by the pressure due to the passing resistance through the porous material 20 although the influence was still less than the prior art jet nozzle tube. The flow rate change due to the passing resistance through the 10-mm long porous material 20 occurred because the valve function of the porous material 20 worked and this proves that the flow rate is adjustable.

According to the above comparative experiments, compared to the prior art jet nozzle tube, the jet nozzle tube 14 according to the present invention made it possible in both to obtain stable ejection characteristics of fluids (a liquid and a gas), namely stable and constant ejection effect. This proves that the porous material 20 realizes, as its action, a stirred and entirely uniformly mixed state of fluids (a liquid and a gas) that flow within the tube channel 12.

INDUSTRIAL APPLICABILITY

The present invention is adopted in the flow path tube 1 having the tube channel 12 for passing fluids (a liquid and a gas) and can be used as any flow path tube 1 regardless of the field of application such as the jet nozzle tube 14 and the aerosol valve tube 16. Hence, the "flow path tube and jet nozzle tube and aerosol valve tube using flow path tube" according to the present invention is deemed to have a high industrial applicability.

1 Flow path tube
10 Flow path tube body
10*a* Leading end
10*b* Leading end face
10*c* Base end
12 Tube channel
14 Jet nozzle tube
16 Aerosol valve tube
18 Ejection hole
20 Porous material
20*a* Leading end face
22 Insert part
24 Leading end part
26 Valve body
26*a* Ejection outlet
28 Coating

The invention claimed is:

1. A flow path tube comprising a porous material within the tube channel of a flow path tube body, wherein the porous material has a continuous void structure, a necessary length, and a necessary diametrical dimension enabling insertion into the tube channel of the flow path tube body, and at least one or more porous materials are inserted and disposed at given positions within the tube channel of the flow path tube body; and further including, the flow path tube body is opened at the leading end, a resin material is applied on the leading end face of the porous material to form a coating for the purpose of sealing, and at least one or more ejection holes are formed in either one or both of the leading end face of the porous material on which the coating is formed and the outer periphery of the flow path tube body at the position at which the porous material is disposed.

2. The jet nozzle tube according to claim 1, wherein the porous material is disposed next to the leading end or near the leading end at a given distance from the leading end within the tube channel of the flow path tube body.

3. A flow path tube comprising a porous material within the tube channel of a flow path tube body, wherein the porous material has a continuous void structure and comprises an insert part having a necessary length and a necessary diametrical dimension enabling insertion into the tube channel of the flow path tube body and a leading end part having a necessary length and a necessary diametrical dimension, and the insert pan of the porous material is inserted from the leading end of the flow path tube body and fixed within the tube channel, and further including, a resin material is applied on the outer surface of the leading end part of the porous material to form a coating for the purpose of sealing, and at least one or more ejection holes are formed in either one or both of the outer surface of the leading end part of the porous material on which the coating is formed and the outer periphery of the flow path tube body at the position at which the insert part of the porous material is disposed.

* * * * *